United States Patent [19]

Moller et al.

[11] Patent Number: 4,875,657

[45] Date of Patent: Oct. 24, 1989

[54] RAIL REPAIRING METHOD AND APPARATUS

[75] Inventors: Ronald H. Moller; Alan K. Batty, both of New South Wales, Australia

[73] Assignee: Thermit Australia Pty. Limited, New South Wales, Australia

[21] Appl. No.: 199,663

[22] Filed: May 27, 1988

[30] Foreign Application Priority Data

May 28, 1987 [AU] Australia ..... PI 2197

[51] Int. Cl.[4] ..... B22D 19/10

[52] U.S. Cl. ..... 249/86; 164/92.1; 164/332

[58] Field of Search ..... 164/92.1, 53, 54, 332, 164/333, DIG. 12; 29/402.18; 249/86

[56] References Cited

U.S. PATENT DOCUMENTS

| | | | |
|---|---|---|---|
| 1,947,966 | 2/1934 | Begtrup | 249/86 |
| 2,932,863 | 4/1960 | Ahlert | 164/54 |
| 3,189,959 | 6/1965 | Ahlert et al. | 164/54 |
| 3,495,801 | 2/1970 | Kruger | 164/54 X |
| 3,545,526 | 12/1970 | Funk | 164/92.1 X |
| 3,623,207 | 11/1971 | Zoso et al. | 29/402.18 X |
| 4,250,944 | 2/1981 | Moring | 164/54 |

FOREIGN PATENT DOCUMENTS

| | | | |
|---|---|---|---|
| 389918 | 2/1924 | Fed. Rep. of Germany | 164/DIG. 12 |
| 1600992 | 10/1981 | United Kingdom | 249/86 |

*Primary Examiner*—Nicholas P. Godici
*Assistant Examiner*—J. Reed Batten, Jr.
*Attorney, Agent, or Firm*—Ladas & Parry

[57] ABSTRACT

A mould for the repairing of a damaged portion of a rail head, the mould includes a pair of mould halves which engage the longitudinal sides of the rail so as to provide a cavity above the damaged portion of the rail, molten metal is subsequently delivered to the cavity which molten metal passes across the top of the rail. The molten metal is allowed to cool and excess metal is removed to restore the shape of the rail head.

6 Claims, 2 Drawing Sheets

RAIL REPAIRING METHOD AND APPARATUS

Figure 1:
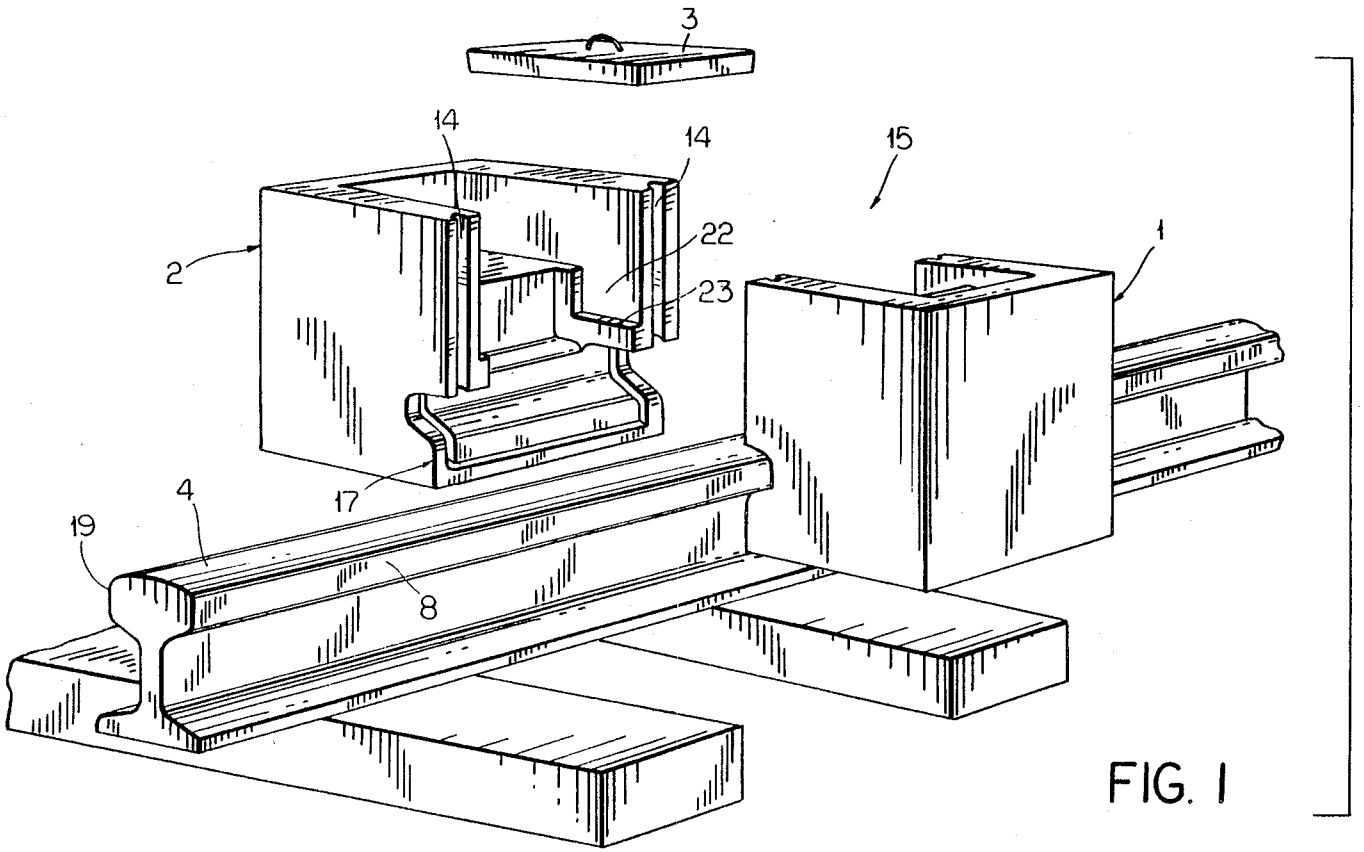

This invention relates to repair of railway lines or tracks and is concerned with a two piece mould adapted to engage a piece of damaged track and a method of utilising such a mould to effect track repair.

Railway tracks are readily damaged as, for example, by wheel burns which occur when a train is stopped on an upward incline and re-starts using sand to allow the train wheels to grip the tracks. On occasions such as these, small dents or grooves may be cut into a section of track by the spinning wheels, such dents being, perhaps, of 2 mm to 5 mm depth and of 10 cm length. Faults in rail material can occasion surface cracks and cavities which need repair. Further, soft welds at rail joint can lead to wear indentations, Absent repair, damage may be caused which will lead to premature track replacement, and jolting of train carriages with consequent discomfort to passengers, possible damage to goods in transit and damage to train engines and carriages.

Conventional repair techniques have involved cutting out a section of the line around the damaged portion and build-up welding that section to conform with the original rail shape. Excess material is removed and the repaired portion then ground smooth.

This conventional technique for rail repair is expensive and labour extensive. In general, such repair work is economical only if, with rails still in good condition, the distance does not exceed 5% of the rail length and defective spots are located at some distance apart.

It is the object of this invention to provide a method and apparatus for the improved repair of railway lines or tracks.

There is disclosed herein a mould to aid in the repair of a rail head of a rail, said mould including a pair of mould parts to be removably applied to the rail head so as to generally surround a damaged portion of the rail head, said mould pair co-operating to define a cavity extending through the mould and within which the damaged portion is located, said cavity extending between a pair of side openings and including a bottom opening generally closed by the rail, and means defining an upper limit of the cavity to define the quantity of metal that may be retained within the cavity together with said rail head.

The invention in a further broad form provides a method of repairing a rail head portion, said method comprising positioning about a damaged rail portion a mould pair, said mould pair being adapted to provide a path for molten steel, pouring molten steel into said mould pair, said molten steel being directed across the top portion of said rail head to remove therefrom a portion of said rail head and removing said mould pair when said molten steel has sufficiently cooled. Preferably thereafter, excess steel is removed from said rail and the rail ground to conform with the undamaged rail head.

It is preferred that the damaged rail head portion is preheated with a preheating torch or like implement to facilitate removal of the top part of the rail head portion by the molten steel. It is further preferred that this preheating is effected after the mould pair "halves" have been placed around the damaged rail portion and that a removable plug be provided to allow such preheating. This plug is placed between the mould halves after the preheating step and the molten steel poured over this plug and through an opening between the plug and one of the mould halves. The molten steel then traverses the rail head, removing a region thereof surrounding the damaged portion and flows into a well provided in the other mould half. When sufficient molten steel has been poured to fill the well, any excess molten steel will appear at the opening between the first mould half and the plug. Pouring of the steel is then stopped. When the poured steel has cooled sufficiently the mould halves are removed and the rail head portion sheared and ground.

Figure 2:
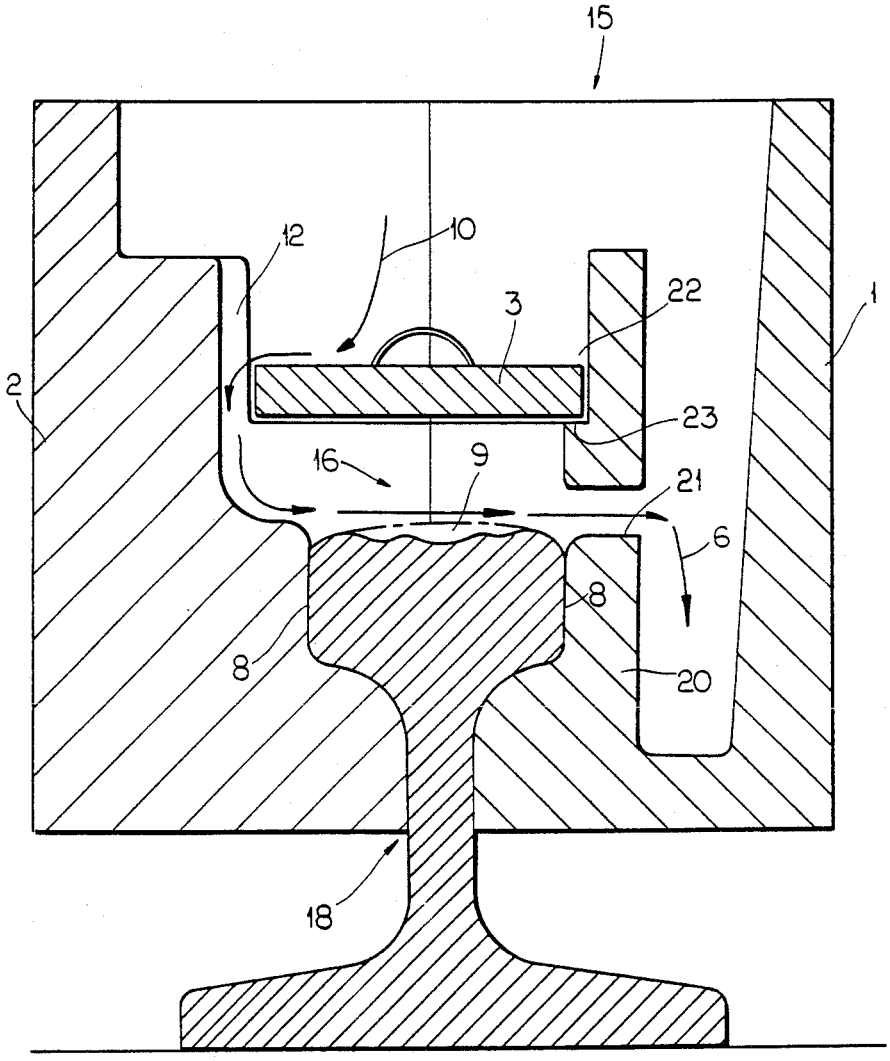

By way of example only, one embodiment of a mould pair according to this invention will now be described with reference to the accompanying drawings, wherein:

FIG. 1 is a perspective view showing a mould pair of this invention and a rail portion of which is to be accommodated by the mould pair; and FIG. 2 is a section of a mould pair of this invention located in accommodation about a rail head portion.

In the accompanying drawings there is illustrated a mould assembly 15 including a mould half 1 incorporating well 6, and cast to fit snugly around one side of damaged rail head 4. Mould half 2 fits snugly around the other side or rail head 4 so that, when both mould halves are so fitted around rail head 4 a minimal quantity of, if any, molten steel introduced to the mould will transfer to the sides 8 of rail head 4. Grooves 14 are provided in mould half 2 and complementary grooves (not shown) are provided in mould half 1. Sealant is placed in these grooves so that the damaged rail head portion is isolated when the mould halves are placed therearound. When mould halves 1, 2 are so fitted around rail head 4 the damaged portion 9 of rail head 4 is at first visible. A preheating torch is directed at this portion 9 of rail head 4 to preheat the same to a derived degree. Plug 3 is then placed in location over rail head 4 in the cavity between mould halves 1 and 2. A gap 12 is provided between plug 3 and mould half 2 to allow molten steel to be poured into the mould to follow path 10. In following this path, the molten steel enters the cavity between the mould halves, traverses the upper lid portion, is introduced to the preheated rail head portion 9, removes a region about damaged portion 9 and flows, with this removed portion into well 6. When a predetermined amount of molten steel has been poured, this amount being pre-calculated according to the size of the rail and the quantum of damage thereto, pouring is ceased. When the molten steel has cooled sufficiently, the mould halves are removed and, in due course, the affected rail head section sheared and ground to conform with the previously undamaged rail portion.

The mould halves 1 and 2 therefor co-operate to provide a cavity 16 which extends through the mould assembly 15 so as to provide open side cavity faces 17, and an open bottom face 18. The faces 17 and 18 are closed by the rail 19.

The mould half 1 has a dam well 20, the upper surface 21 of which defines the upper limit of the cavity 16. The mould half 1 has a pair of opposing recesses 22 providing seats 23 for the plug.

What we claim is:

1. A mould to aid in the repair of a rail head of a rail, said mould including a pair of mould parts to be removably applied to the rail head so as to generally surround a damaged portion of the rail head, said mould pair co-operating to define a cavity extending through the mould and within which the damaged portion is located, said cavity extending between a pair of side openings and including a bottom opening generally closed by the rail, and dam means defining an upper limit of the cavity to determine the quantity of molten metal that may be retained within the cavity together with said rail head, with excess molten metal being allowed to pass over said dam means.

2. The mould of claim 1 wherein a first one of said mould part snugly engages one of the longitudinal sides of said rail, and the other mould part snugly engages the other longitudinal side of said rail.

3. The mould of claim 2 wherein said other mould part includes a well to receive excess molten metal from said cavity.

4. The mould of claim 3 wherein said dam means includes a dam wall separating said cavity and said well, said dam wall having an upper surface defining the upper limit of said cavity.

5. The mould of claim 4 further including plug means positioned above said cavity and co-operating with one of the mould parts to define an inlet to said cavity through which the molten metal enters said cavity, which inlet is positioned laterally of said rail.

6. The mould of claim 5 wherein said plug means is removable to expose said cavity.

* * * * *